United States Patent [19]

Hayashi

[11] Patent Number: 4,577,170

[45] Date of Patent: Mar. 18, 1986

[54] VARIABLE TUNING FILTER IN HIGH FREQUENCY CIRCUIT

[75] Inventor: Isao Hayashi, Tokyo, Japan

[73] Assignee: Kyocera Corporation, Japan

[21] Appl. No.: 696,928

[22] Filed: Jan. 31, 1985

[30] Foreign Application Priority Data

Feb. 2, 1984 [JP] Japan ..... 59-14847[U]

[51] Int. Cl.[4] ..... H01P 1/203; H01P 7/08

[52] U.S. Cl. ..... 333/205; 333/223; 333/235; 333/246

[58] Field of Search ..... 333/202–205, 333/235, 246, 219, 222, 223, 174; 334/15, 41, 45

[56] References Cited

U.S. PATENT DOCUMENTS 3,451,015 6/1969 Heath ..... 333/204 X

*Primary Examiner*—Marvin L. Nussbaum

*Attorney, Agent, or Firm*—Spensley Horn Jubas & Lubitz

[57] ABSTRACT

A high frequency tuning filter having a grounding conductive layer on one side of a dielectric substrate and figure eight (8)-shaped resonance electrodes of an electrically conductive film layer on the other side is improved into a variable tuning filter for a high frequency circuit which has a plurality of resonators surrounded by figure 8-shaped grooves respectively which are each formed in the electrically conductive layer in such a manner that a portion of an electrically conductive layer small in width remains in the figure 8-shaped groove and the electrically conductive layer remains between the adjacent resonators, and which also has a region formed by removing a part of the grounding conductive layer over the resonators.

2 Claims, 3 Drawing Figures

VARIABLE TUNING FILTER IN HIGH FREQUENCY CIRCUIT

BACKGROUND OF THE INVENTION

This invention relates to a variable tuning filter in a high frequency circuit.

In a typical high frequency apparatus, operated for instance at 900 MHz, when a desired frequency is selected out of a wide band of several channels, tuning is accomplished by changing the local frequency at the intermediate frequency stage in the signal receiving circuit. However, this method often suffers from the inclusion of interferences such as mutual modulation interference and image interference, because unwanted signals are amplified and mixed in the signal receiving circuit.

In a conventional $\frac{1}{4}\lambda$ resonator as shown in FIG. 1, an electrically conductive layer having a pattern as indicated by the oblique lines is formed on a dielectric layer. More specifically, a plurality of strip lines $S_1$ and $S_2$ are connected to trimmer capacitors $C_{T1}$ and $C_{T2}$, and the other ends of the strip lines are connected to a common grounding electrode. In order to obtain the matching of input and output with such a conventional resonator, the input-output parts $P_1$ and $P_2$ extended from the strip lines $S_1$ and $S_2$ must be positioned carefully.

Therefore, with the conventional resonator the matching of input and output and the improvement of the quality factor in the high frequency band are very difficult to achieve. Because of these drawbacks the employment of such a resonator is not practical.

SUMMARY OF THE INVENTION

An object of this invention is to eliminate the above-described difficulties accompanying a conventional resonance filter.

The foregoing object and other objects of the invention have been achieved by improving a high frequency tuning filter having a grounding conductive layer on the whole surface of one side of a dielectric substrate and comb-shaped resonance electrodes of an electrically conductive film layer on the other side, into a variable tuning filter in a high frequency circuit. This circuit includes a plurality of resonators each provided by forming a figure 8-shaped groove in the electrically conductive layer in such a manner that an electrically conductive layer small in width remains in the figure 8-shaped groove and the electrically conductive film layer remains between the adjacent resonators, and a region which is formed by removing a part of the grounding conductive layer in such a manner as to be positioned over the resonators.

The nature, principle and utility of the invention will become more apparent from the following description when read in conjunction with the accompanying drawings.

DETAILED DESCRIPTION OF THE DRAWINGS

One embodiment of a variable tuning filter according to this invention will be described with reference to FIG. 2.

Figure 2:
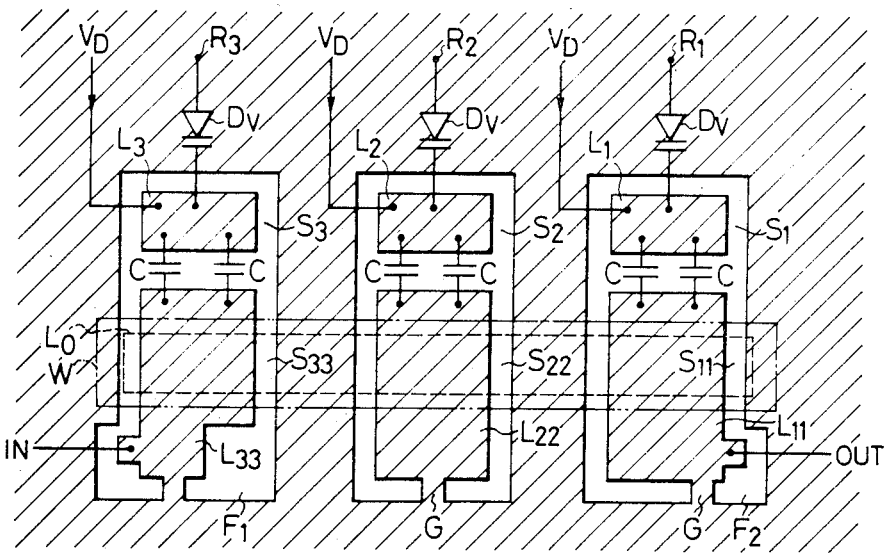
FIG. 2 is a top view showing one embodiment of a variable tuning filter according to this invention.

FIG. 2 is a top view showing a plurality of resonators $R_1$, $R_2$ and $R_3$ formed on an electrically conductive surface. The rear surface (not shown) is a grounding conductive layer which except for peeled regions (described later) acts as a grounding electrode. At input and output terminals IN and OUT and at the connecting terminals of coupling capacitors C and variable capacity elements Dv, the electrically conductive film layer and the grounding conductive layer are electrically connected to each other through through-holes formed in the printed circuit board. First terminals of the coupling capacitors C of the resonators $R_1$, $R_2$ and $R_3$ are connected to first lands $L_1$, $L_2$ and $L_3$, respectively, and the remaining terminals of the coupling capacitors C are connected to second lands $L_{11}$, $L_{22}$ and $L_{33}$, respectively. The lands $L_1$ and $L_{11}$, $L_2$ and $L_{22}$, and $L_3$ and $L_{33}$ are surrounded by figure 8-shaped insulation grooves $S_1$ and $S_{11}$, $S_2$ and $S_{22}$, and $S_3$ and $S_{33}$, respectively, which are formed by partially removing the electrically conductive film layer in such a manner that the electrically conductive film layer remains between the adjacent resonators.

Figure 1:
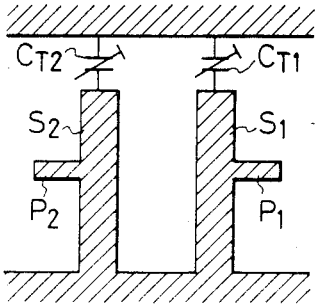
FIG. 1 is a top view showing a conventional $\frac{1}{4}\lambda$ resonator.

The second lands are connected through resonance current flow paths G to the grounding conductive layer. The second lands are different in configuration from one another as shown in FIG. 1; however, they all have electrically conductive layers which are relatively small in width.

On the other hand, in the grounding conductive layer, a region formed by removing the conductive layer encircled by the one-dot chain line (W) is provided over the second lands of the resonators $R_1$, $R_2$ and $R_3$, and, if necessary, an isolated land surrounded by the dotted line $L_O$ may be provided.

Figure 3:
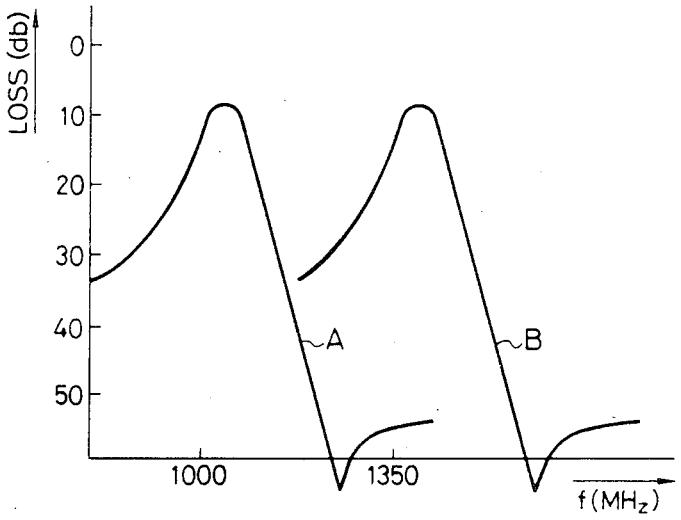
FIG. 3 is a characteristic diagram showing loss with frequency in the filter of the invention.

The Q characteristics of loss versus frequency for a frequency range higher than 1,000 MHz are as indicated in FIG. 3 for the present invention. In FIG. 3, the curve A is the resonance Q characteristic which was obtained when a voltage $V_D$ applied to the variable capacity elements was 2 volts ($V_D=2$ volts), and the curve B is the resonance Q characteristic which was obtained with $V_D=15$ volts. As is apparent from FIG. 3, in each of the resonance Q characteristic, the Q is high, and therefore the Q characteristic is maintained unchanged over a range of 300 MHz, i.e., the tuning filtering characteristic is excellent. In the above-described measurements, the insertion loss of the three resonators was less than 8 dB with a glass substrate and even less with a "Teflon" TM substrate. Hence, a signal 200 MHz higher than the central frequency and having a band width of about 50 MHz could be attenuated more than 40 dB.

As is apparent from the above description, in the variable tuning filter according to the present invention, the electrically conductive layer is interposed between the adjacent resonators, the resonance current flow paths to the grounding conductive layer are provided by the electrically conductive film layers small in width, and on the grounding conductive layer side the conductive layer which is over the resonators is removed. Therefore, the degree of unwanted coupling to the ground is decreased, and the coupling of the resonators is improved, thus reducing the loss in the filtering operation. Furthermore, the Q characteristic is made high, thereby allowing the selection of a frequency out of a wide high frequency range with ease. Thus, the prior difficulties encountered in the tuning operation can be eliminated completely, and the assembling work can be achieved with higher efficiency.

What is claimed is:

1. A high frequency variable tuning filter comprising:

a dielectric substrate;

a grounding conductive layer on the surface of one side of the substrate and an electrically conductive film layer on the other side thereof;

a plurality of adjacent resonators each including two areas of the electrically conductive layer formed by a figure eight shaped groove in said electrically conductive layer, wherein a portion of the electrically conductive layer small in width remains in said 8-shaped groove to connect one of said two areas to the portion of the electrically conductive layer outside of said groove, and wherein a portion of said electrically conductive film layer remains between the adjacent resonators; and a region on said one side of the dielectric substrate which is positioned opposite the resonators, wherein the region is formed by removing a part of said grounding conductive layer.

2. A high frequency variable tuning filter comprising:

a dielectric substrate;

an electrically conductive film layer disposed on one side of said substrate;

a grounding layer disposed on the other side of said substrate;

a plurality of laterally spaced resonators each formed by removing portions of said conductive film to form a groove having a figure eight configuration whereby two separate regions of said conductive film are defined within the boundaries of said groove, the first region being isolated from the remainder of said conductive film, wherein the second region is connected to the remainder of said conductive film outside said groove by means of a bridge of said conductive film crossing said groove;

a variable capacity element connected to said first region of each of said resonators;

one or more coupling capacitors connected between said first and second regions in each of said resonators; and an elongated area located on said other side of the substrate and extending transversely across said second region of each of said resonators and formed by removing a portion of said grounding layer.

* * * * *